US005954879A

United States Patent [19]

Lison et al.

[11] Patent Number: 5,954,879

[45] Date of Patent: Sep. 21, 1999

[54] DEVICE FOR APPLYING A TREATMENT LIQUID TO A WEB

[75] Inventors: Ingo Lison, Seifhennersdorf; Peter Pfeiffer, Olbersdorf; Steffen Greif, Spitzkunnersdorf, all of Germany

[73] Assignee: Kusters Zittauer Maschinenfabrik GmbH, Zittau, Germany

[21] Appl. No.: 09/029,512

[22] PCT Filed: Apr. 30, 1996

[86] PCT No.: PCT/DE96/00744

§ 371 Date: Feb. 27, 1998

§ 102(e) Date: Feb. 27, 1998

[87] PCT Pub. No.: WO97/08375

PCT Pub. Date: Mar. 6, 1997

[30] Foreign Application Priority Data

Aug. 29, 1995 [DE] Germany ..... 195 31 663

[51] Int. Cl.[6] ..... B05C 3/02

[52] U.S. Cl. ..... 118/405; 118/419

[58] Field of Search ..... 68/22 B, 43, 5 E; 118/419, 405, 115, 114, 117, 427, 424, 423

[56] References Cited

U.S. PATENT DOCUMENTS

| | | |
|---|---|---|
| 4,862,713 | 9/1989 | Kutz et al. . |
| 4,878,365 | 11/1989 | Kutz et al. . |

FOREIGN PATENT DOCUMENTS

| | | |
|---|---|---|
| 0 566 832 | 10/1993 | European Pat. Off. . |
| 1 460 265 | 1/1969 | Germany . |
| 37 33 996 | 4/1989 | Germany . |
| 42 13 127 | 7/1993 | Germany . |

*Primary Examiner*—Brenda A. Lamb
*Attorney, Agent, or Firm*—Kenyon & Kenyon

[57] ABSTRACT

An application device having a trough tapering downward in a wedge shape, through which a web is guided vertically from top to bottom, and which is sealed at the lower end by means of a horizontal hose. The hose abuts against the web from one side, while the web slips along on the opposite side at the lower end of the side surface of the trough. The side surface is formed on a counter-bearer, which is concave at its lower side, so that a deflection roller arranged beneath it can be set as high as possible, and the free web section from the hose gap to the contact point on the deflection roller is as short as possible.

13 Claims, 2 Drawing Sheets

3
1'
100
17
16'
16'
17
2
16
II
II
16
15
15
11
1
4
4'
4''
14
18
5
13
6
12
7
21
9
4'''
22
8
19
18
1''
1'''
20

10
4'
9
18
20
13
13'
14
1
11
6
5
16
16
4

DEVICE FOR APPLYING A TREATMENT LIQUID TO A WEB

BACKGROUND OF THE INVENTION

The invention relates to a device for the simultaneous application of treatment liquid to both sides of a web, particularly a textile web.

Devices of this general type are disclosed in DE-PS 14 60 265 and DE 37 33 996 C2. In the known embodiments, arranged in the "opposite side surface" of the trough, opposite an inflatable hose, is another such inflatable hose, so that the web passes between the two hoses. The additional hose results in a space requirement corresponding to its cross-section on its side, so that design freedom is limited at this location.

In the device disclosed in DE-PS 14 60 265, the web continues to run vertically downward after passing by the interacting hoses, and passes through a pair of squeezer rollers, in which applied treatment liquid is at least partially squeezed out. In DE 37 33 996 C2, the web also continues vertically downward after passing by the hoses, and is then guided via a deflection roller after a certain distance.

There are treatments of textile webs in which the web demonstrates a strong tendency to shrink after the treatment liquid is applied. This is particularly pronounced when cotton material is saturated with an alkaline solution, as is the case in the mercerization process.

In mercerization, the strong tendency toward shrinkage is counteracted in that, after the mercerization solution is applied, the web is held in a so-called bound web guidance in which the web is guided over a sequence of deflection rollers which rest against one another or virtually rest against one another, and no free web sections whatsoever occur between the deflection rollers. The web is held tightly on the circumference of the deflection rollers, as a result of the friction which comes about from the web tension, in an effort to prevent shrinkage.

A characteristic of the application devices of the type set forth above is the possibility of saturating the web with a relatively high amount of treatment liquid, in the range of 100 to 200% of the mass per unit area. The web is uniformly wiped off at the hoses, and exits the application device with a charge which cannot be easily achieved with other application devices. At the same time, the charge is present on both sides and is actually massaged slightly into the interior of the web when it passes through the slit between the hoses.

It has been shown that if mercerization solution is applied to a textile web with an application device of the type known in the prior art, shrinkage occurs virtually spontaneously. The free web sections which result from DE-PS 14 60 265 and DE 37 33 996 C2 result in unacceptable shrinkage amounts when the application device is used in such a way.

SUMMARY OF THE INVENTION

The object of the present invention is to develop an application device of the general type discussed above in such a way that the free section which exists after the web leaves the gap at the hose arrangement prior to its arrival at a bound web guidance becomes as short as possible.

This objective is attained via a device for simultaneously applying treatment liquid to both sides of a web, (particularly a textile web), in which a trough extends over the width of the web and has fixed side surfaces that, when viewed in a vertical plane transverse to the web, present a cross-section that tapers downwardly in a wedge shape narrowing towards a wedge tip. The side surfaces are wider than the web they bound and have ends that are connected to cross-walls forming a liquid-tight seal with respect to the side surfaces. One of the side walls is the wall of a counter-bearer and has, at its lower end, a closed smooth section of wall defining a contact region against which the web can be pressed. There is further provided a horizontally disposed hose which is arranged in a region of the wedge tip in an open recess in one of the side walls, and which can be inflated in the direction of the opposite side wall formed on the counter-bearer. A further device supplies treatment liquid to the trough. A web guidance mechanism is used for guiding the web vertically from the top downward, through the trough and the gap between the hose and the opposite side surface of the trough. The web is clamped in place between the hose and the opposite side surface of the trough, the trough being sealed toward the bottom by the action of the hose and the web. The web is wiped by the hose as it passes the hose and the lower portion of the wall opposite the hose to a specific charge of treatment fluid, which can be selected in accordance with the inflation pressure of the hose. A deflection roller having an outer working surface is arranged below the counter-bearer and provides a surface against which the web is guided vertically downward out of the hose gap and against which the web rests. The counter bearer has a lower side that is positioned adjacent the deflection roller so as to minimize the distance the length of web between the deflection roller and the hose.

It has been found that affixing the inflatable hose on only one side does not result in any loss in application quality and sealing of the trough toward the bottom. This saves space on the side opposite the existing hose, permitting the deflection roller to be moved as close as possible to the hose gap.

The counter-bearer has the shape of a box-bearer, and has a concave lower side which is adapted in radius to the circumference of the deflection roller and which is formed by the one tip, opposite the hose, which engages down in the wedge-shaped opening between the downward-running web and the deflection roller which is tangential to it. In this way, the deflection roller can be placed as high as possible, so that the section from the hose gap to the deflection roller is short.

In a preferred embodiment, the deflection roller is driven, in order to thereby be able to pull the web through the hose gap, and, at the same time, to exert a lengthwise tension to counteract the lengthwise shrinkage of the web likewise occurring.

According to another aspect of this invention, the deflection roller is but the first roller of a downstream treatment segment of the apparatus providing the web with bound guidance. In this manner, a transition can be made practically directly from charging the web with the treatment liquid, particularly a mercerization solution, to a treatment segment with bound web guidance. A relatively large amount of treatment liquid can be applied which, avoiding a significant free web section, enters immediately into the bound web guidance and can dwell there.

According to a further aspect of the invention, the upper rollers are partially arranged in gaps in the lower rollers (as is known in the field) so as to provide a meander about which the web can travel without any free lengths of web between the rollers. This is especially useful in subsequent treatment segments, e.g., as is done in mercerization machines.

An important characteristic with respect to the large amounts of treatment liquid that may be applied and the virtually direct transition into the bound web guidance provided by the apparatus is the use of mountings that permit the upper rollers to be lifted off of two adjacent lower rollers. By being able to lift the upper rollers in the usual mercerization roller sequence, squeezing can be avoided at the transition from one deflection roller to the next, and the effect of the large application of treatment liquid can be maintained over at least part of the subsequent treatment segment in the bound web guidance. The result achieved with the application device and the arrangement of the deflection roller, namely the high charge and the practically direct transition into the bound web guidance, thus can have its full effect. The relatively large amount of treatment liquid on the web has an opportunity to act on it over a longer dwell segment.

The mountings of the upper rollers can permit free self-adjustment of the upper rollers relative to the adjacent lower rollers in each instance. The upper rollers are therefore not rigidly mounted, but rather "loosely" mounted, i.e. they are guided rather than mounted, and can thus find their optimum contact position.

It can be advantageous for at least one more of the lower rollers which follow the deflection rollers to be driven, in order to be able to bring about not only a bound web guidance to avoid crosswise shrinkage, but also a certain lengthwise stretching of the web, at least at some points. A prerequisite for this is, of course, that the driven lower roller in question and the following upper roller do not touch to form a roller nip.

The drawing shows an exemplary embodiment of the invention in schematic form.

DETAILED DESCRIPTION

Figure 1:
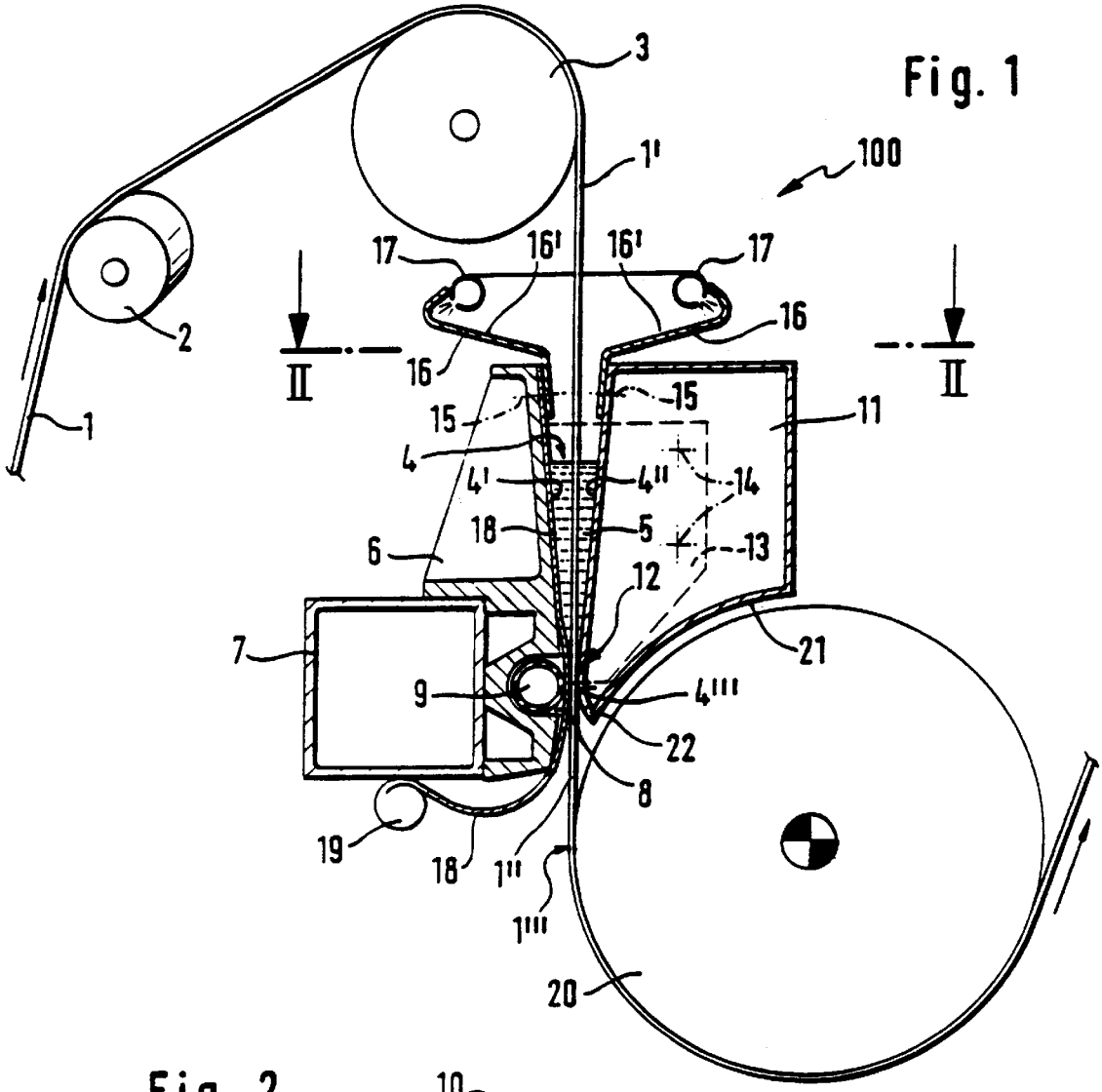
FIG. 1 is a cross-sectional view of an application device constructed according to the principles of the invention.

In the application device 100 shown in FIG. 1, a textile web 1 made of cotton material is guided over a spreader roller 2 and an upper deflection roller 3, in order to be guided from there, in a section 1' which runs vertically downward, through a trough 4 containing a treatment liquid 5. Trough 4 extends at least over the width of web 1 and possesses a flat left side surface 4' as seen in FIG. 1 and a similarly flat right side surface 4", which approach one another downwards, forming a wedge-shaped cross-section in a vertical plane transverse to web 1. Side surfaces 4' and 4" are arranged symmetrically to web section 1, which forms a vertical plane, so that when web 1 passes through trough 4, it is charged with treatment liquid on both sides.

Left side surface 4' is formed by a carrier 6, which in turn is supported on a carrier beam 7 in the form of a hollow-profile beam with a square cross-section. In a vertical plane transverse to web 1, carrier 6 has the cross-sectional shape evident in FIG. 1. In a recess 8 which is open toward the right in FIG. 1, i.e. toward web 1, an inflatable hose 9 which extends horizontally over the width of web 1 is arranged; it can be filled with compressed air at a controllable pressure via an external connection 10, and bulges out slightly from recess 8, toward the right in FIG. 1, under the pressure.

Side surface 4" of trough 4 which lies opposite hose 9 is formed by the wall of a box-shaped counter-bearer 11, which also extends over the width of the web. In at least region 4'" opposite hose 9, it is made of polished, corrosion-resistant steel having good sliding properties for web 1 so as to provide a smooth, closed sliding surface for it. Formed between hose 9 and region 4'" is hose gap 12, through which web 1 passes.

At the rigid and smooth lower region 4'" of side wall 4", web 1 readily slips by on this side of hose gap 12. In order to improve the slip at flexible hose 9, a foil 18 of thin, corrosion-resistant sheet metal is provided, which extends over the width of the web and is clamped in place, by means of screw 15, between the upper region of side wall 4' and the sheet-metal guide provided there. Slip foil 18 extends downward beyond side wall 4', in front of hose 9, through hose gap 12, sags in the form of a free loop below hose gap 12, and is fixed in place there on a holder 19.

Figure 2:
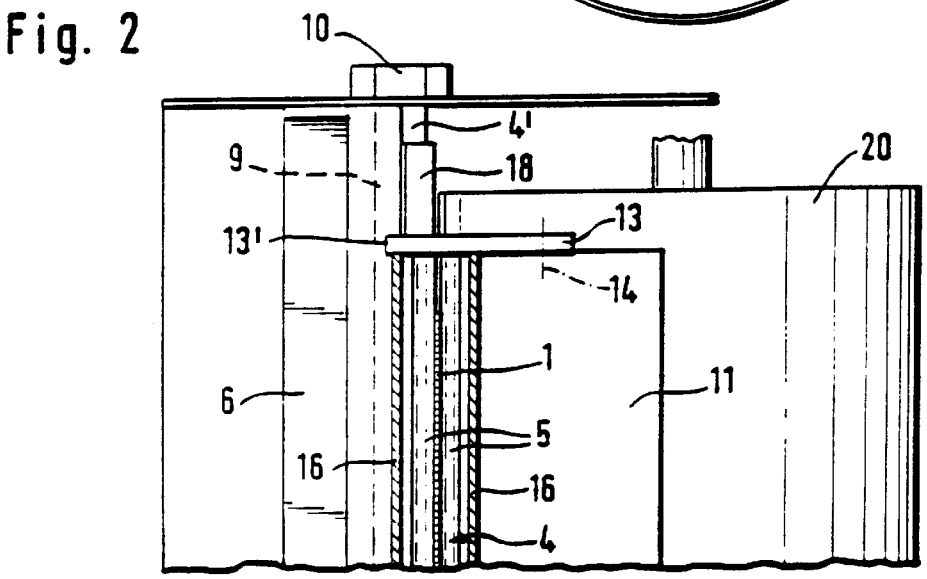
FIG. 2 is a partial cross-sectional view of the application device taken along Line II—II of FIG. 1.

Hose gap 12 delimits trough 4 toward the bottom. At the two ends of trough 4, there is a delimitation by means of end plates 13, which are attached in the manner indicated, by means of screws 14, on the faces of the counter-bearer, forming a seal, and which form cross-walls which extend to the opposite side surface 4' of carrier 6. The carrier reaches beyond the face of counter-bearer 11 in each instance. This also holds true for slip foil 18, which rests against side surface 4' and is pressed against it to form a seal by face 13' of end plate 13 in each instance, in which a seal can be arranged (FIG. 2).

Inflatable hose 9 presses web 1 against lower region 4'" of side surface 4". As web 1 passes through hose gap 12, it is stripped or wiped on both sides to a relatively high moisture content, determined by the pressure in hose 9. The moisture content can amount to 100 to 200% of the mass per unit area of the dry goods.

Trough 4 contains only a small amount of treatment liquid, which is constantly renewed. To this end, attached at the upper ends of side surfaces 4' and 4", by means of screws 15, are angled sheet-metal guides 16 which form run-off surfaces 16' that are inclined toward trough 4, and on whose upper edge the treatment liquid is applied from feed lines 17; as the treatment liquid flows down over run-off surfaces 16, it forms a uniform film which flows, in a laminar flow, along side surfaces 4', 4" into trough 4.

After web 1 has passed through trough 4 and hose gap 12, it continues on its way below hose gap 12, vertically downward in a section 1", which extends to contact point 1'" on the circumference of a deflection roller 20 arranged below counter-bearer 11. Web 1 then wraps around deflection roller 20 in its lower region and is located on it in "bound guidance", i.e. it is held in place on the roller by contact friction and cannot shrink freely. Section 1" is an unavoidable free web section, which should be designed to be as short as possible.

In order to minimize the length of free web section 1", lower side 21 of counter-bearer 11 is designed to be concave, corresponding to the outer perpheral surface of deflection roller 20, and arranged directly above this surface. As a result, deflection roller 20 can be set higher, in order to bring contact point 1'" as close as possible to hose gap 12. In its cross-section, counter-bearer 11 forms a tip 22, which reaches down into the wedge-shaped opening between section 1" of the web and the circumference of deflection roller 20, and there, at the lower end of side wall 4", has region 4'" of slipping contact with web 1, and forms hose gap 12. In this manner, section 1" of web 1 becomes as short as is possible for a design with a trough 4 formed of fixed side surfaces 4', 4".

Figure 3:
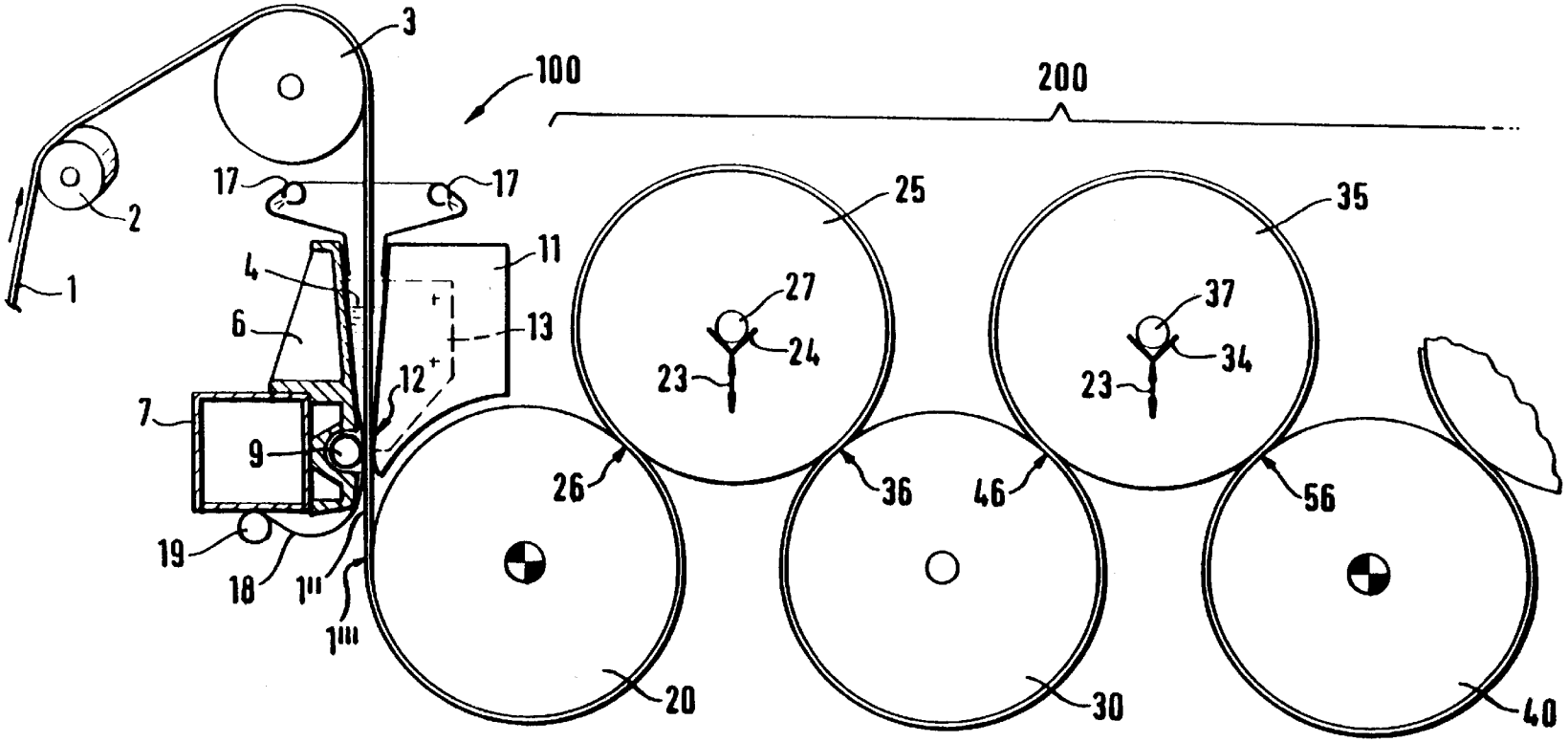
FIG. 3 is a side view of the application device with a subsequent treatment segment.

FIG. 3 shows the interaction of application device 100 with a subsequent treatment segment 200 providing bound web guidance. Treatment segment 200 is comprised of a sequence of deflection rollers. These comprise lower rollers 20, 30, and 40, arranged parallel to one another in a horizontal plane, of which lower roller 20 is formed by deflection roller 20 of FIGS. 1 and 2, lower rollers 20 and 40 being driven in the illustrated embodiment. Lower rollers 20, 30, and 40 have the same diameter and are set at equal distances from one another, which are less than the diameter. Provided in the gaps between lower rollers 20 and 30, and 30 and 40, respectively, are non-driven upper rollers 25 and 35 of this diameter as well. The web is guided over the sequence of deflection rollers 20, 25, 30, 35, 40, . . . in meander shape, and has no free web section in treatment segment 200. Upper rollers 25 and 35 can rest against lower rollers 20, 30, 40 at points 26, 36, 46 and 56, and they are mounted "loosely", i.e. they can find their contact position by themselves. Here, points 26, 36, 46 and 56 form roller nips at which web 1 experiences linear force. This can be undesirable in certain cases, for example if the relatively large amount of treatment liquid applied in application device 100 is not supposed to be squeezed out again right away.

For this purpose, journals 27 and 37 of upper rollers 25 and 35 are mounted in elbows 24 and 34, which can be lifted and lowered in the direction of arrows 23. Lifting can be performed to such an extent that upper rollers 25 and 35 are just lifted off the lower rollers at points 26, 36 and 46, 56, respectively, so that bound web guidance is not really given up, but nevertheless no roller nip with a squeezing linear force is formed. In the lowered state, the loose mountings symbolized by elbows 24 have only a guidance function, and upper rollers 25, 35 actually rest against lower rollers 20, 30 and 30, 40, respectively, creating a linear force.

When upper rollers 25 and 35 are lifted, the web, with a high charge, can make a transition into the bound web guidance practically immediately, and can remain, with the charge, in treatment segment 200 without being squeezed.

What is claimed is:

1. A device for simultaneously applying treatment liquid to both sides of a web, comprising:

a trough extending over the width of the web, said trough having fixed side surfaces that, when viewed in a vertical plane transverse to the width of the web, present a cross-section that tapers from a top portion of said trough downwardly in a wedge shape to a wedge tip formed in a bottom portion of said trough, the side surfaces being wider than the web and having ends that are connected to cross-walls forming a liquid-tight seal with respect to the side surfaces, wherein one of the side surfaces is the wall of a counter-bearer and has, at its lower end, a closed smooth section of the wall defining a contact region against which the web can be pressed;

a horizontally disposed hose which is arranged in a region of the wedge tip in an open recess in one of the side walls, and which can be inflated in the direction of the counter-bearer, wherein only one of the side surfaces has the recess and the hose contained therein;

a device for supplying treatment liquid to the trough;

a web guidance device for guiding the web vertically downward from the top of said trough to a gap between the hose and the wall of the counter bearer, the web being pressed in place between the hose and the opposite side surface of the trough, and the trough being sealed toward the bottom, wherein the hose cooperates with the wall of the counter bearer such that the web is wiped by the hose as it passes the hose to a specific charge of treatment fluid, which can be selected in accordance with the inflation pressure of the hose; and a deflection roller having an outer working surface, the deflection roller being arranged below the counter-bearer and providing a surface against which the web is guided vertically downward out of the hose gap and against which the web laterally rests, wherein the counter bearer has a lower side that is positioned adjacent the deflection roller so as to minimize distance between where the web contacts the hose and then the deflection roller.

2. A device as set forth in claim 1, wherein the counter-bearer has a generally box shape in cross-section, and has a concave lower side which is arranged directly above the outer working surface of the deflection roller.

3. A device as set forth in claim 2, wherein the curvature of the concave lower side of the counter-bearer matches the curvature of the deflection roller.

4. A device as set forth in claim 2, further comprising means for driving the deflection roller.

5. A device as set forth in claim 1, further comprising means for driving the deflection roller.

6. A device as set forth in claim 5, wherein the deflection roller is first with respect to a travel path of the web of a series of rollers in a subsequent treatment segment that provides bound guidance to the web.

7. A device as set forth in claim 6, wherein the series of rollers in the treatment segment comprises lower rollers separated from one another by gaps and upper rollers that are arranged so that they extend partially in said gaps, the upper and lower rollers each having a top and bottom surface and being arranged so that they provide a path about which the web is guided in meander shape around the bottom of the lower rollers and around the top of the upper rollers, in such a way that there are no free web sections between the upper and lower rollers which are adjacent.

8. A device as set forth in claim 7, further comprising a means for driving at least one or more of the lower rollers which are arranged downstream from the deflection roller with respect to the travel path of the web.

9. A device as set forth in claim 7, wherein the upper rollers are placed on mountings that permit the upper rollers to be lifted off of two of the lower rollers which are adjacent to one another.

10. A device as set forth in claim 9, wherein the mountings of the upper rollers permit free self-adjustment of the upper rollers relative to the lower rollers which are adjacent to one another.

11. A device as set forth in claim 10, further comprising a means for driving at least one or more of the lower rollers which are arranged downstream from the deflection roller with respect to the travel path of the web.

12. A device as set forth in claim 1, wherein the deflection roller is first with respect to a travel path of the web of a series of rollers in a subsequent treatment segment that provides bound guidance to the web.

13. A device as set forth in claim 1, wherein the web is a textile web.

* * * * *